United States Patent [19]

Ruiter

[11] Patent Number: 5,042,556

[45] Date of Patent: Aug. 27, 1991

[54] DOOR ASSEMBLY INCLUDING A MOVABLE DOOR WITH A FLEXIBLE DOOR PANEL

[75] Inventor: Mark A. Ruiter, Amersfoort, Netherlands

[73] Assignee: Polynorm N.V., Bunschoten, Netherlands

[21] Appl. No.: 435,972

[22] Filed: Nov. 14, 1989

[30] Foreign Application Priority Data

Dec. 1, 1988 [NL] Netherlands ..... 8802968

[51] Int. Cl.[5] ..... E05D 15/16

[52] U.S. Cl. ..... 160/201; 160/271

[58] Field of Search ..... 160/201, 19, 133, 23.1, 160/271, 270

[56] References Cited

U.S. PATENT DOCUMENTS

| | | | |
|---|---|---|---|
| 2,846,254 | 8/1958 | Forest | 160/201 |
| 2,947,354 | 8/1960 | Nectoux | 160/201 X |
| 3,129,752 | 4/1964 | Whiting | 160/201 |
| 3,142,333 | 7/1964 | Kummerman et al. | 160/133 X |
| 3,693,693 | 9/1972 | Court | 160/201 X |
| 4,219,067 | 8/1980 | Hurst | 160/201 X |
| 4,717,196 | 1/1988 | Adams | 160/201 X |
| 4,794,973 | 1/1989 | Perisic | 160/201 X |
| 4,795,206 | 1/1989 | Adams | 160/201 X |
| 4,807,687 | 2/1989 | Finch et al. | 160/133 |
| 4,811,777 | 3/1989 | Chretien | 160/201 |

FOREIGN PATENT DOCUMENTS

| | | | |
|---|---|---|---|
| 2036188 | 2/1971 | Fed. Rep. of Germany | 160/201 |
| 2421259 | 11/1979 | France | 160/201 |

*Primary Examiner*—David M. Purol

*Attorney, Agent, or Firm*—Christie, Parker & Hale

[57] ABSTRACT

A door assembly for a doorway opening, such as a garage opening, comprises a door with a flexible door panel. The flexible door panel is guided around rotatable guide wheels between a closed position and an open position. When in the open position, the flexible door panel is substantially horizontal to maximize the height clearance of the doorway opening.

8 Claims, 4 Drawing Sheets

DOOR ASSEMBLY INCLUDING A MOVABLE DOOR WITH A FLEXIBLE DOOR PANEL

The invention relates to a door comprising a flexible panel of flexible plate material which is guided around guide means from a closed position to an opened position.

Such a door is known and is especially, but not exclusively, intended for closing garages. It is important that in the opened position the door leaves clear the greatest possible height clearance, in order to allow for passage of the tallest vehicles as possible.

An object of the invention is to maximize the height clearance in the opened position, whereby the door operates without difficulties.

Accordingly the door according to the invention has the feature that the flexible panel of flexible plate material assumes a substantially horizontal position in the opened state and is guided on both sides by guide means at the location where the plate material bends. A horizontal panel edge is coupled for pivoting to a strengthening profile.

Such a horizontal panel edge could cause problems in the operation of the door because of excessive sagging. However, the door according to the invention is easy to operate because the pivotable strengthening profile can be directed easily around the guide means, thereby holding the horizontal edge of the flexible plate material straight.

These and other features of the invention will be elucidated in the description following hereinafter with reference to the drawings.

DESCRIPTION OF THE PREFERRED EMBODIMENTS

Figure 1:
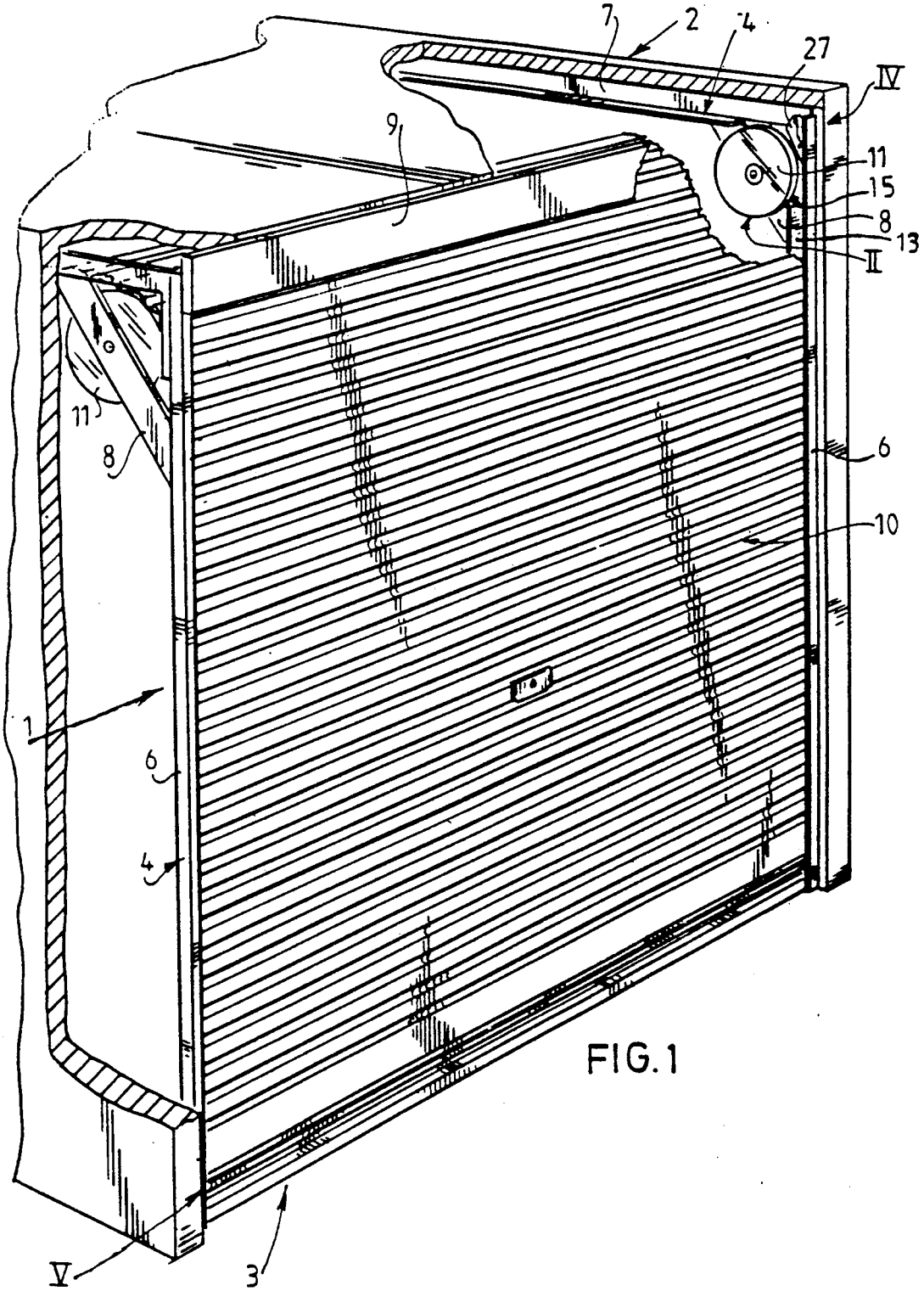
FIG. 1 shows a partly broken away perspective view of a garage with a door assembly according to the invention.

A door 1 according to the invention can be fitted as a prefabricated unit in the passage opening 3 of a garage 2. For this purpose side frames 4 are fixed in a manner not shown to the side walls 5 of garage 2. Each side frame 4 consists of a vertical U-shaped side frame 6 and a horizontal angle frame 7 which are joined by means of a brace 8. The side frames 4 are mutually connected by a horizontal beam 9 which closes off the top of the passage opening 3 defines the height clearance. A door panel 10 consisting of flexible steel plate material flexible in the horizontal direction and having a thickness of 0.5 mm, for example, is guided in the U-shaped side frame 6 and the horizontal angle frames 7. Also, door panel 10 is guided behind the horizontal beam 9, specifically at the location where door panel 10 bends, by means of guide wheels 11 which are each mounted for rotation on a brace 8 by means of a bearing sleeve 41 and a bearing piece 42. The periphery of guide wheels 11 comes into contact with the path of movement of the door panel 10. At this location the frames 6 and 7 are recessed, and a flange 13 with a sloping edge 15 directed towards the guide wheel 11 is provided. Also conceivable instead of a guide wheel 11 is a fixed part-circular guiding. A guide wheel 11 is greatly preferred.

Figure 6:
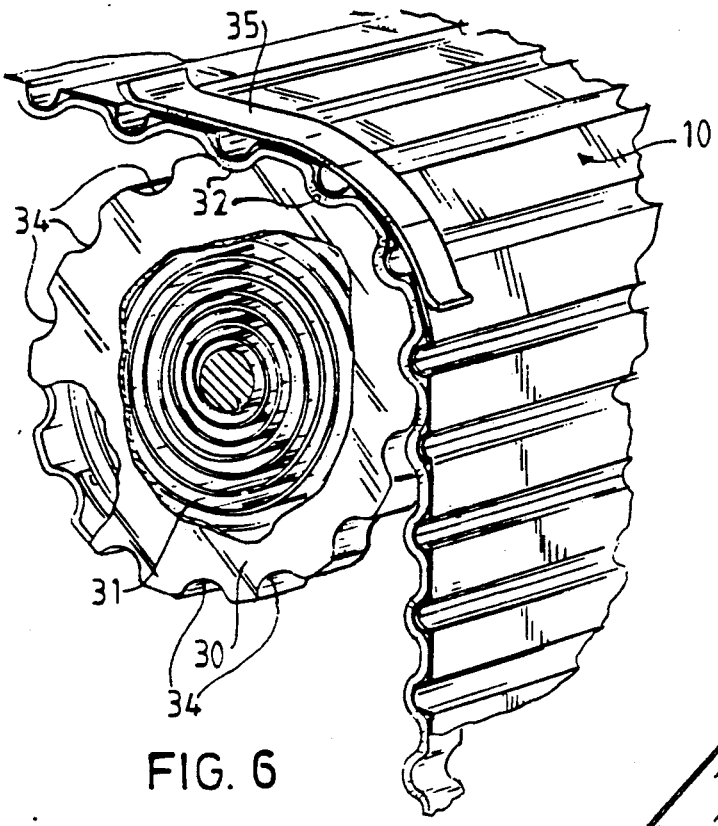
FIG. 6 shows a variant of section II.
Figure 5:
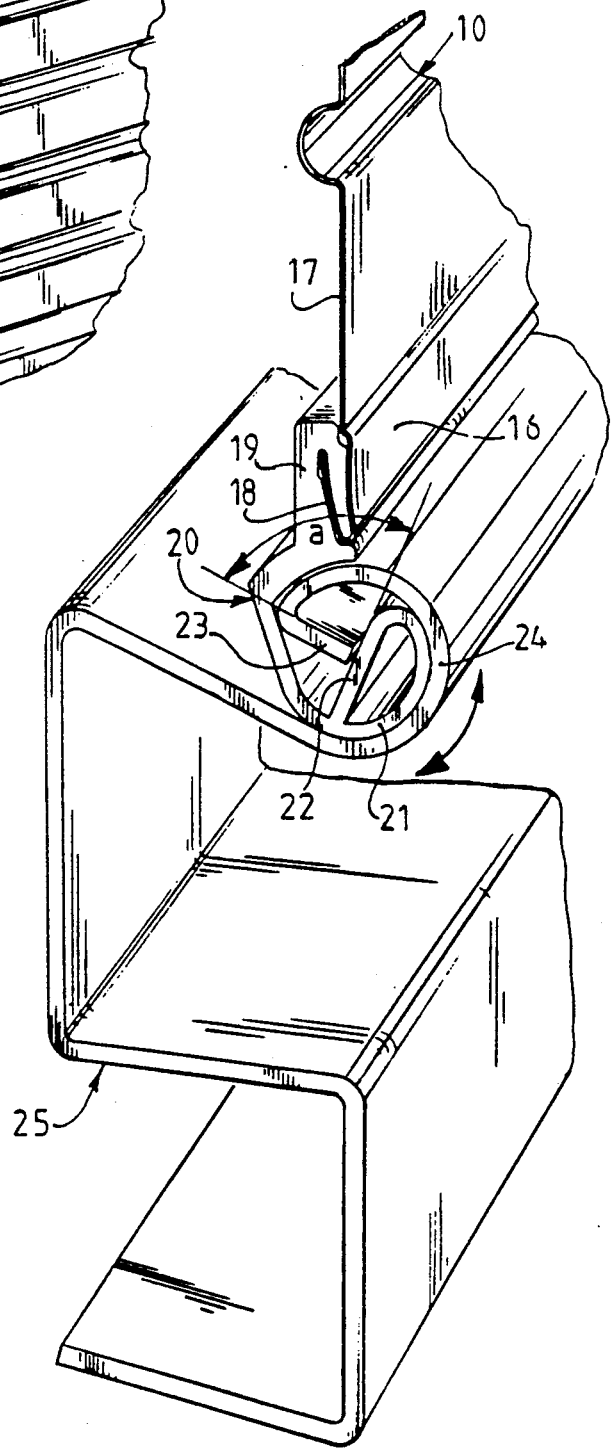
FIG. 5 shows on a larger scale a perspective view of section V in FIG. 1.
Figure 2:
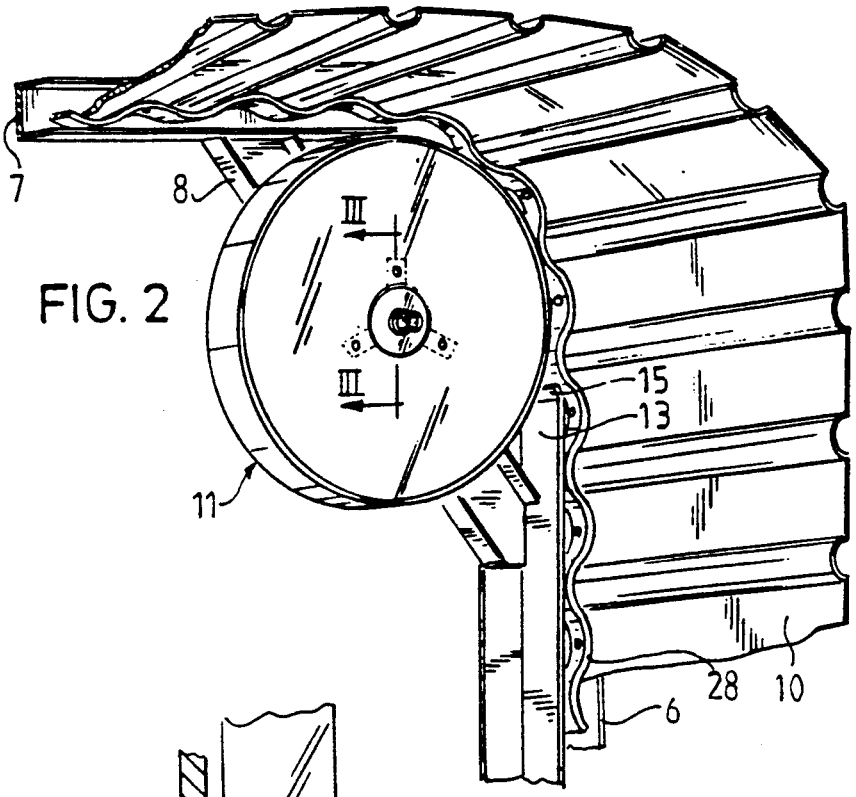
FIG. 2 shows on a larger scale a perspective view of section II of FIG. 1.
Figure 3:
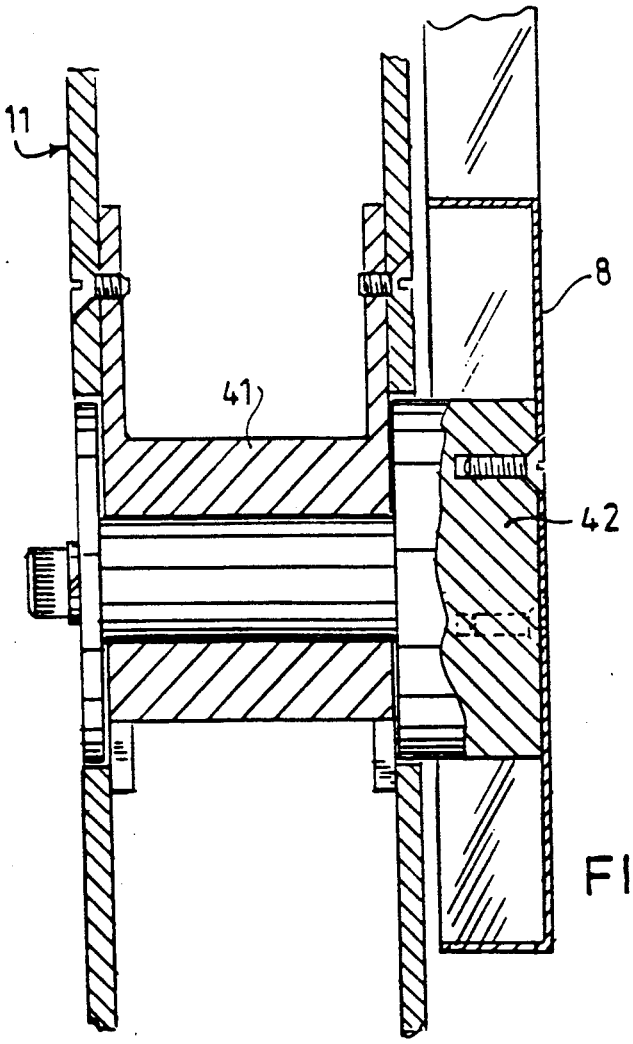
FIG. 3 shows on a larger scale a section along the line III—III in FIG. 2.
Figure 4:
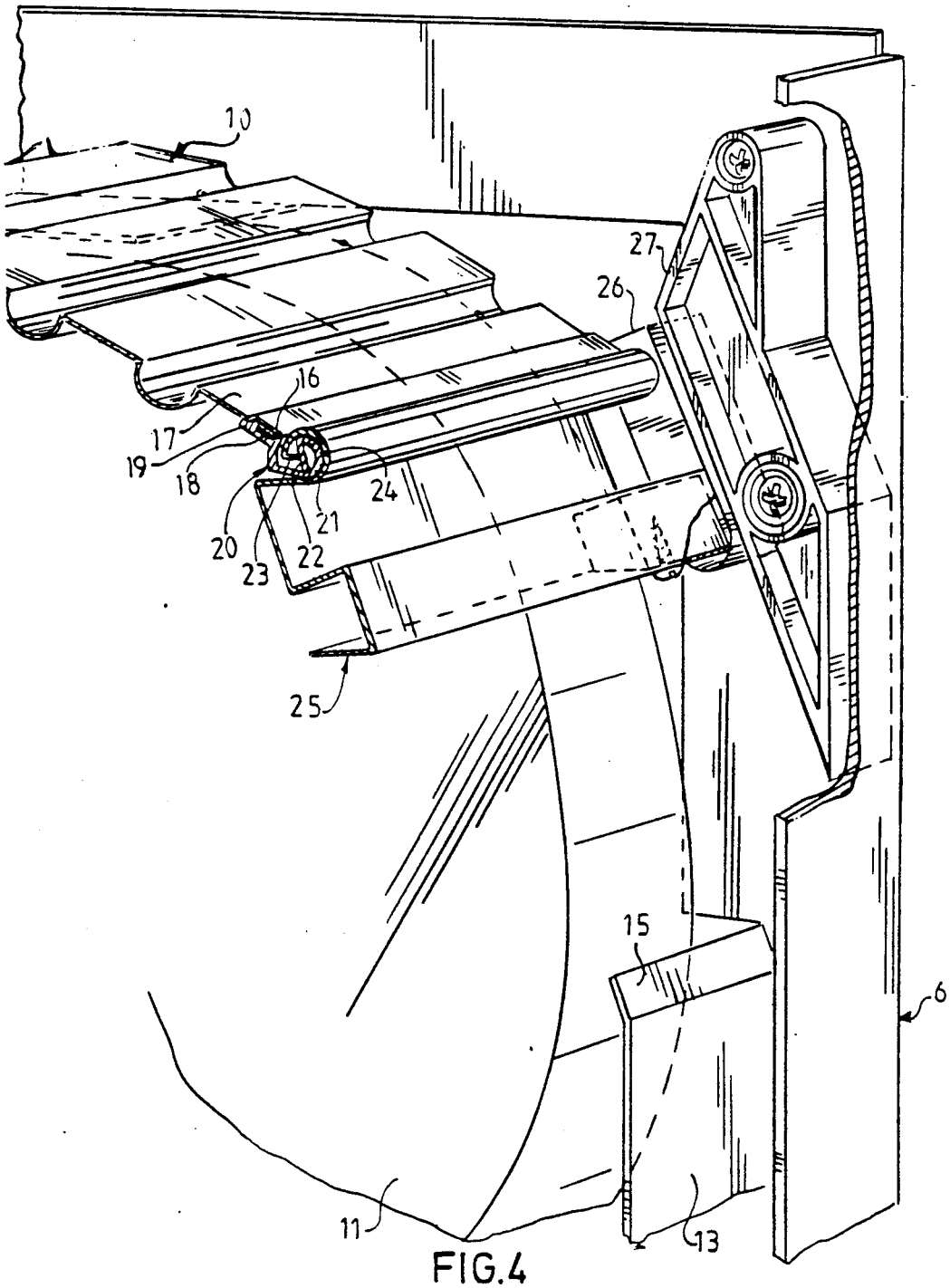
FIG. 4 shows on a larger scale a perspective view of section IV of FIG. 1.

A horizontal panel edge 16 of the flexible plate material 17 is bent over as an angle section 18 and is clamped fixedly into an angle section 19 of a profile-like edge strip 20, the other edge of which is bent in the form of a partial cylinder. Specifically, a semi-cylindrical hinge piece 21 has a diametric end piece 22 which forms a stop for a radially directed end piece 23 of a partial-cylindrical shaped piece 24. The partial-cylindrical shaped piece 24 accommodates the hinge piece 21 with a tight fit and provides a pivotal connection therewith and which forms a piece of a substantially S-shaped strengthening strip 25. As a result of the use of this strengthening strip 25 and the hinged attachment thereof to the horizontal edge 16 of the door panel 10, the door panel 10 may be easily guided from the opened position shown in FIG. 4 and easily pulled into the closed position. Especially in combination with the rotatable guide wheel 11 the door panel 10 is easy to operate without the panel having the tendency to go out of track or to become stuck. The strengthening strip 25 has on either end a guide block 26 of plastic which is rounded off at its front side and cooperates for guiding with a stationary guide means 27 arranged on the U-shaped side frame 6. The door panel 10 has on its edges guide strips 28 of plastic. The door panel 10 is preferably balanced by means of springs, for example compression or draw springs which grip onto the ends of the door panel 10, or coil springs 31 accommodated in the guide wheels 30 as in FIG. 6, whereby the door panel 10 then grips with shaped ridges 32 into specially adapted hollows 34 of the guide wheel 30. A guide bar 35 made of plastic holds the door panel 10 in engagement with the hollows 34.

I claim:

1. A door assembly for a vertical doorway opening comprising:

a door movable between an open position and a closed position, said door comprising a flexible door panel having two opposed side edges and a lower horizontal panel edge, said flexible door panel being substantially horizontal in the open position and bendable along its horizontal axis;

guide means for guiding said flexible door panel as it moves between a closed position and an open position, said guide means comprising a pair of opposed rotatable guide wheels near the top of each side of said doorway opening, the perimeters of said rotatable guide wheels contacting an inner surface of said flexible door panel near each of its two opposed side edges whereby said flexible door panel bends along its horizontal axis as the portions of the two opposed side edges contact the perimeter of said rotatable guide wheels, and said guide means further comprising a vertical U-shaped side frame extending downward from each of said rotatable guide wheels along each side of said doorway opening for slidably engaging the opposed side edges of the flexible door panel; and a horizontal strengthening strip pivotally connected to the lower horizontal panel edge of the flexible door panel, said lower horizontal panel edge being attached to an edge strip and said edge strip being pivotally engaged to the horizontal strengthening strip; and means for limiting the pivotal rotation between the horizontal strengthening strip and the edge strip to a predetermined angle of rotation.

2. The door assembly according to claim 1, wherein a lower portion of the horizontal strengthening strip has a substantially S-shaped cross-sectional profile.

3. The door assembly according to claim 1, wherein a lower portion of the horizontal strengthening strip has a substantially S-shaped cross-sectional profile.

4. The door assembly according to claim 3, wherein an upper portion of the horizontal strengthening strip has a gripping edge for pivotally engaging said edge strip.

5. The door assembly according to claim 1 further including a guide member extending from each end of the horizontal strengthening strip, and a stationary guide means at each side of said doorway opening near the top of said U-shaped side frame which cooperates with said guide member for guiding the opposed side edges of the flexible door panel into engagement with said vertical U-shaped side frames as the door is moved from the open position to the closed position.

6. The door assembly according to claim 1, further including guide strips on an inner surface of the flexible door panel along each of the opposed side edges of the flexible door panel for contacting the perimeter of the rotatable guide wheels.

7. The door assembly according to claim 6, wherein each guide strip comprises a plurality of ridges extending from an inner surface of said flexible door panel and each rotatable guide wheel includes corresponding notches in its perimeter for engaging said ridges of the guide strip.

8. The door assembly according to claim 1, wherein the flexible door panel is composed of a single sheet of metal.

* * * * *